US007290520B2

(12) United States Patent
Cavanagh et al.

(10) Patent No.: US 7,290,520 B2
(45) Date of Patent: Nov. 6, 2007

(54) FUEL INJECTOR NOZZLE FOR AN INTERNAL COMBUSTION ENGINE

(75) Inventors: Mark S. Cavanagh, Bloomington, IL (US); Roger L. Urven, Jr., Colona, IL (US); Keith E. Lawrence, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 33 days.

(21) Appl. No.: 11/353,998

(22) Filed: Feb. 15, 2006

(65) Prior Publication Data

US 2006/0231064 A1 Oct. 19, 2006

Related U.S. Application Data

(62) Division of application No. 10/448,063, filed on May 30, 2003, now Pat. No. 7,032,566.

(51) Int. Cl.
*F02B 3/08* (2006.01)

(52) U.S. Cl. ..... 123/299

(58) Field of Classification Search ..... 239/533.12, 239/533.1, 533.3; 123/299, 305
See application file for complete search history.

(56) References Cited

U.S. PATENT DOCUMENTS

| | | | |
|---|---|---|---|
| 1,468,370 | A | 9/1923 | Morse |
| 1,529,531 | A | 5/1925 | Young |
| 1,833,080 | A | 11/1931 | Kenworthy |
| 1,966,223 | A | 7/1934 | Sass |
| 1,988,754 | A | 1/1935 | Sleffel |
| 2,618,928 | A | 11/1952 | Nathan |
| 3,892,208 | A | 7/1975 | Anderson et al. |
| 4,057,190 | A | 11/1977 | Kiwior et al. |
| 4,548,172 | A | 10/1985 | Bailey |
| 4,919,093 | A | 4/1990 | Hiraki et al. |
| 4,932,374 | A | 6/1990 | Klomp et al. |
| 5,315,973 | A | 5/1994 | Hill et al. |
| 5,373,694 | A | 12/1994 | Clark |
| 5,931,391 | A | 8/1999 | Tani et al. |

(Continued)

FOREIGN PATENT DOCUMENTS

| | | |
|---|---|---|
| DE | 4136851 | 5/1993 |

(Continued)

OTHER PUBLICATIONS

A New Concept for Low Emission Diesel Combustion SAE Technical Paper Series, Feb. 24-27, 1997 Hino Motors.

(Continued)

*Primary Examiner*—Stephen K. Cronin
*Assistant Examiner*—Arnold Castro
(74) *Attorney, Agent, or Firm*—Finnegan, Henderson, Farabow, Garrett & Dunner

(57) ABSTRACT

A direct injection fuel injector includes a nozzle tip having a plurality of passages allowing fluid communication between an inner nozzle tip surface portion and an outer nozzle tip surface portion and directly into a combustion chamber of an internal combustion engine. A first group of the passages have inner surface apertures located substantially in a first common plane. A second group of the passages have inner surface apertures located substantially in at least a second common plane substantially parallel to the first common plane. The second group has more passages than the first group.

12 Claims, 7 Drawing Sheets

U.S. PATENT DOCUMENTS

| | | | | |
|---|---|---|---|---|
| 6,070,812 | A | 6/2000 | Tani et al. | |
| 6,089,476 | A | 7/2000 | Sugimoto et al. | |
| 6,161,780 | A | 12/2000 | Sugimoto et al. | |
| 6,186,418 | B1 | 2/2001 | Tani | |
| 6,382,179 | B1 | 5/2002 | Hansson | |
| 6,434,945 | B1 | 8/2002 | Mandai et al. | |
| 6,553,960 | B1 | 4/2003 | Yoshikawa et al. | |
| 6,616,070 | B1 | 9/2003 | Kunkulagunta | |
| 6,644,268 | B2 | 11/2003 | Konig et al. | |
| 6,742,493 | B2 | 6/2004 | Ziegler et al. | |
| 6,769,635 | B2 | 8/2004 | Stewart et al. | |
| 6,832,594 | B2 | 12/2004 | Hiraya et al. | |
| 6,840,209 | B2 | 1/2005 | Shimazaki | |
| 6,843,434 | B2 | 1/2005 | Lawrence et al. | |
| 6,854,438 | B2 | 2/2005 | Hilger et al. | |
| 2002/0083920 | A1 | 7/2002 | Konig et al. | |
| 2004/0021013 | A1* | 2/2004 | Lawrence | 239/533.12 |

FOREIGN PATENT DOCUMENTS

| | | | |
|---|---|---|---|
| DE | 19953932 | A1 | 5/2001 |
| DE | 10122350 | | 11/2002 |
| EP | 0887525 | A2 | 6/1998 |
| EP | 0864734 | | 9/1998 |
| EP | 0937883 | A2 | 2/1999 |
| EP | 1217186 | A2 | 12/2001 |
| EP | 1219516 | A2 | 9/2002 |
| JP | 10288131 | A | 10/1998 |
| JP | 2002-276373 | | 9/2002 |
| WO | WO-02/02928 | | 1/2002 |

OTHER PUBLICATIONS

3rd Dessau Gas Engine Conference, May 22-23, 2003 in Dessau, Germany; *Diesel & Gas Turbine Worldwide* (Dec. 2002), p. 73.

Alan Bunting: "Bosch unit-injector coming to rival Delphi E3", *World Commercial Vehicles* (Nov. 2002).

Hiromichi Yanagihara, "Ignition Timing Control at Toyota "Unibus" Combustion System"; *A New Generation of Engine Combustion Processes for the Future*!, P. Duret (Editor) and Editions Technip, Paris, 2001, pp. 35-42, 27 rue Ginous, 75015 Paris.

Patent Disclosure Document, English Language Translation of German Patent Document DE 4136 851 A1, "Moderate-power diesel engine", DE 41 36 851 A1 published May 13, 1993, pp. 1-4.

* cited by examiner

FUEL INJECTOR NOZZLE FOR AN INTERNAL COMBUSTION ENGINE

This application is a divisional of U.S. patent application Ser. No. 10/448,063, filed May 30, 2003, now U.S. Pat. No. 7,032,566, the contents of which is incorporated herein by reference.

U.S. GOVERNMENT RIGHTS

The U.S. Government has a paid-up license in this invention and the right in limited circumstances to require the patent owner to license others on reasonable terms as provided for by the terms of Contract Nos. DE-FC05-00OR22806 and DE-FC05-97OR22605 awarded by the Department of Energy.

TECHNICAL FIELD

This invention relates generally to fuel systems for internal combustion engines, and more particularly to nozzle configurations of fuel injectors of fuel systems of internal combustion engines.

BACKGROUND

The conventional combustion process in diesel engines is initiated by the direct injection of fuel into a combustion chamber containing compressed air. The fuel is almost instantaneously ignited upon injection into the highly compressed combustion chamber, and thus produces a diffusion flame or flame front extending along the plumes of the injected fuel. The fuel is directly injected into the combustion chamber by a fuel injector having a nozzle tip extending into the combustion chamber. For example, the nozzle tip may extend slightly into the combustion chamber from a wall of the chamber located opposite a reciprocating piston of the combustion chamber.

More demanding emissions standards have necessitated attempts at reducing smoke and NOx byproducts of the combustion process, while maintaining or improving fuel efficiency. One approach to meeting the difficult emissions standards includes incorporating what has been referred to as a Homogeneous Charge Compression Ignition (HCCI) process into the engine cycle. The HCCI process may be more accurately referred to as a controlled auto-ignition process. Such a process operates by injecting fuel into the combustion chamber prior to the point at which the combustion chamber reaches a pressure sufficient to auto-ignite the fuel. Such a fuel injection timing allows for compression of a diluted mixture of air and fuel until auto-ignition occurs. This controlled auto-ignition process provides a combustion reaction volumetrically within the engine cylinder as the combustion chamber volume is reduced by the piston. This type of combustion avoids localized high temperature regions associated with the flame fronts, and thereby reduces smoke and NOx byproducts of the combustion.

Conventional fuel injectors used for injecting fuel into highly pressurized or relatively lower pressurized combustion chambers include a nozzle tip having a plurality of passages allowing fuel from the injector to be injected into the combustion chamber. The number, size, and orientation of the passages in the nozzle tip affect the production of smoke, production of NOx, and fuel efficiency associated with the combustion.

U.S. Pat. No. 4,919,093 to Hiraki et al. discloses a direct injection type diesel engine having a fuel injector nozzle tip including a plurality of injection holes arranged in two rows concentrically relative to a longitudinal axis of the injector nozzle. The injection holes of the two rows are disclosed as forming a zigzag pattern. Accordingly, as disclosed in the illustrated embodiments, each of the two rows include the same number of injection holes. Further, Hiraki et al. discloses that the distal-most row of holes form an acute angle of 45° or greater with the longitudinal axis of the injector nozzle.

The number, size, and orientations of the holes of the fuel injector nozzle tip of Hiraki et al. provide a narrow range or diffusion of fuel plumes into the combustion chamber. This is evidenced by the fact that the injector holes of the distal-most row of the nozzle tip are orientated to form an arc of 90° between opposing nozzle holes of the row. Accordingly, a majority of the area within the combustion chamber formed by the 90° arc does hot directly receive injected fuel. Such a narrow range of diffusion of fuel plumes limits the mixing of the fuel with the air, thus increasing the localized high temperature regions in the combustion chamber and thereby producing unwanted smoke and NOx.

The present invention provides a fuel system for an internal combustion engine that avoids some or all of the aforesaid shortcomings in the prior art.

SUMMARY OF THE INVENTION

In accordance with one aspect of the invention, a direct injection fuel injector nozzle tip includes an outer nozzle tip surface portion, and an inner nozzle tip surface portion. A plurality of passages allow fluid communication between the inner nozzle tip surface portion and the outer nozzle tip surface portion and directly into a combustion chamber of an internal combustion engine. Each of the plurality of passages has an inner surface aperture on the inner nozzle tip surface portion and an outer surface aperture on the outer nozzle tip surface portion. A first group of the passages have inner surface apertures located in a first common plane. A second group of the passages have inner surface apertures located in at least a second common plane substantially parallel to the first common plane, and the second group having more passages than the first group.

According to another aspect of the present invention, a direct injection fuel injector nozzle tip includes an outer nozzle tip surface portion, and an inner nozzle tip surface portion. A plurality of passages allow fluid communication between the inner nozzle tip surface portion and the outer nozzle tip surface portion and directly into a combustion chamber of an internal combustion engine. Each of the plurality of passages has an inner surface aperture on the inner nozzle tip surface portion and an outer surface aperture on the outer nozzle tip surface portion. A first group of passages have inner surface apertures located in a first common plane. A second group of passages have inner surface apertures located in at least a second common plane substantially parallel to the first common plane. The first group of passages each have a longitudinal axis extending at acute angles alpha ($\alpha$) of 55 degrees or greater from the first common plane, the acute angles alpha ($\alpha$) being measured in a plane perpendicular to the first common plane. The second group of passages each have a longitudinal axis extending at acute angles theta ($\theta$) of 27.5 degrees or greater from the second common plane, the acute angles theta ($\theta$) being measured in a plane perpendicular to the second common plane.

According to yet another aspect of the present invention, a method of providing combustion within a combustion chamber of an internal combustion engine includes providing air into the combustion chamber and injecting fuel into the combustion chamber through a plurality of passages located in a nozzle tip of a fuel injector so as to form a plurality of fuel plumes in the combustion chamber. Each of the plurality of fuel plumes corresponds to one of the plurality of passages and shares a common axis with the corresponding opening. The axis of each passage extends into a piston of the combustion chamber at a piston position of 30 degrees before top dead center. The method further includes compressing the air and fuel in the combustion chamber to auto-ignite the mixture.

DETAILED DESCRIPTION

Reference will now be made in detail to the drawings. Wherever possible, the same reference numbers will be used throughout the drawings to refer to the same or like parts.

Figure 1:
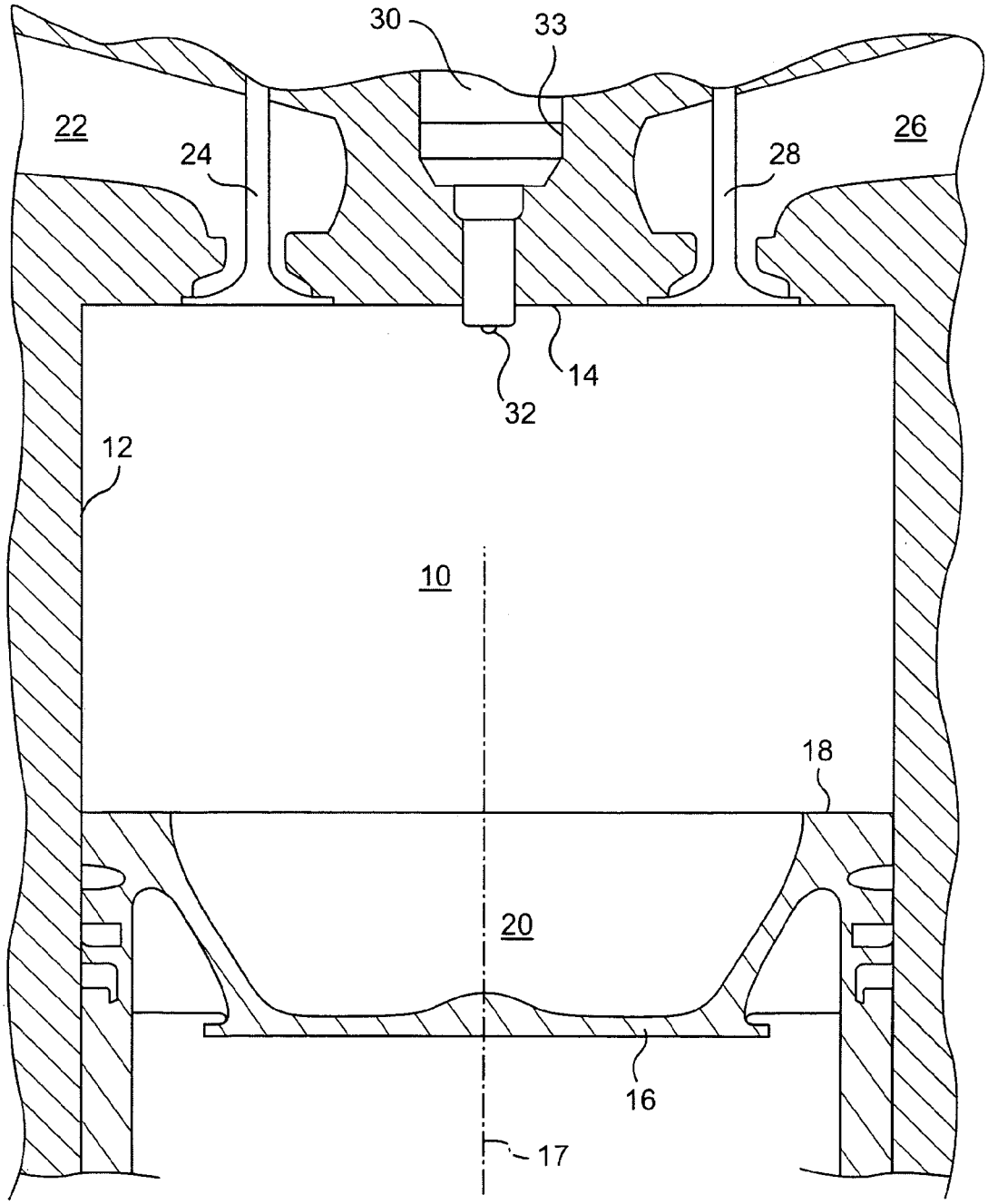
FIG. 1 is a cross-sectional view of a combustion chamber assembly of a internal combustion engine according to the disclosure.

FIG. 1 illustrates a combustion chamber assembly of an internal combustion engine including a combustion chamber 10. Such an engine may include, for example, a four stroke diesel fuel powered engine. The combustion chamber 10 is formed by a cylinder sidewall 12, a cylinder end wall 14, and a reciprocating piston 16, and includes a combustion chamber longitudinal axis 17. The piston 16 may have a top surface 18 forming a piston crater 20. As is conventional in the art, an intake port 22, intake valve 24, exhaust port 26, and exhaust valve 28 may be located about the cylinder end wall 14.

A fuel injector 30 may include a nozzle tip 32 extending directly into the combustion chamber 10 through an opening 33 in the cylinder end wall 14. The fuel injector 30 may be concentric or parallel with the longitudinal axis 17 of the combustion chamber 10 (FIG. 1), or may extend at an acute angle with respect to the longitudinal axis 17 of the combustion chamber. Further, the fuel injector 30 may be of any conventional type. For example, the fuel injector 30 may be of the mechanically actuated, hydraulically actuated, or common rail type, and may be designed for single mode or mixed mode operations.

Figure 2:
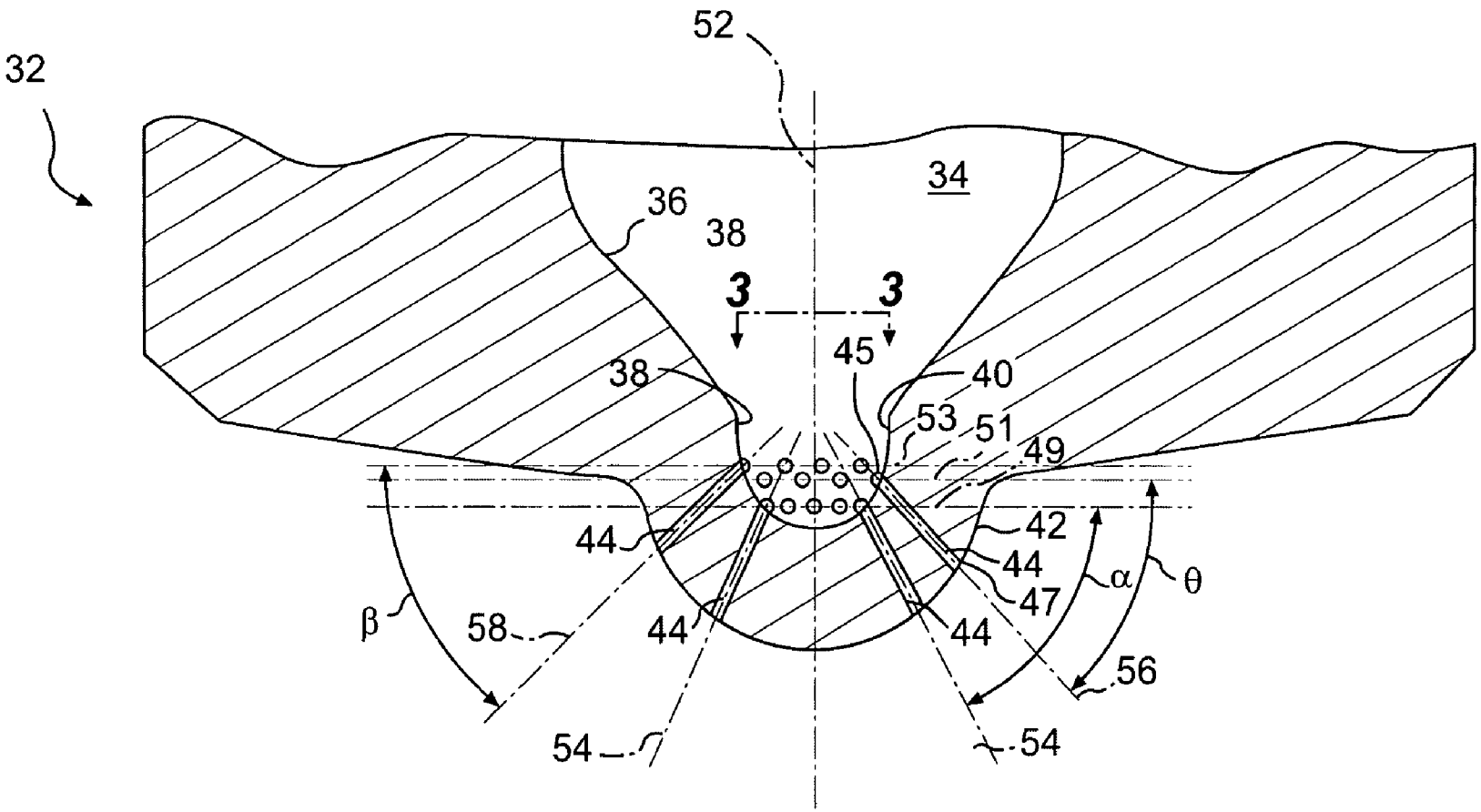
FIG. 2 is an enlarged cross-sectional view of the fuel injector nozzle tip of FIG. 1.

FIG. 2 illustrates an enlarged cross-sectional view of the fuel injector nozzle tip 32 of FIG. 1. The nozzle tip 32 may include an internal valve receiving opening 34 having a tapering valve seat section 36 extending to a distally located tip sac 38. Tip sac 38 may be formed in a substantially concave shape and include an inner surface 40 and an outer surface 42. Tip sac 38 may also include a plurality of passages 44 extending from an inner surface aperture 45 on the inner surface 40 to an outer surface aperture 47 on the outer surface 42 of the tip sac 38. It is understood that nozzle tip 32 may also be formed as a valve closed orifice type nozzle tip, wherein passages 44 are located outside the tip sac 38. Passages 44 may have a substantially constant diameter between their inner surface apertures 45 and their outer surface apertures 47, as shown in FIG. 2. Alternatively, passages 44 may include other configurations such as, for example, a curved or straight taper with a larger diameter at the outer or inner surface apertures (45, 47), radiusing located at either or both of the outer and inner surface apertures (45, 47), or counterbores located at either or both of the outer and inner surface apertures (45, 47).

Figure 3:
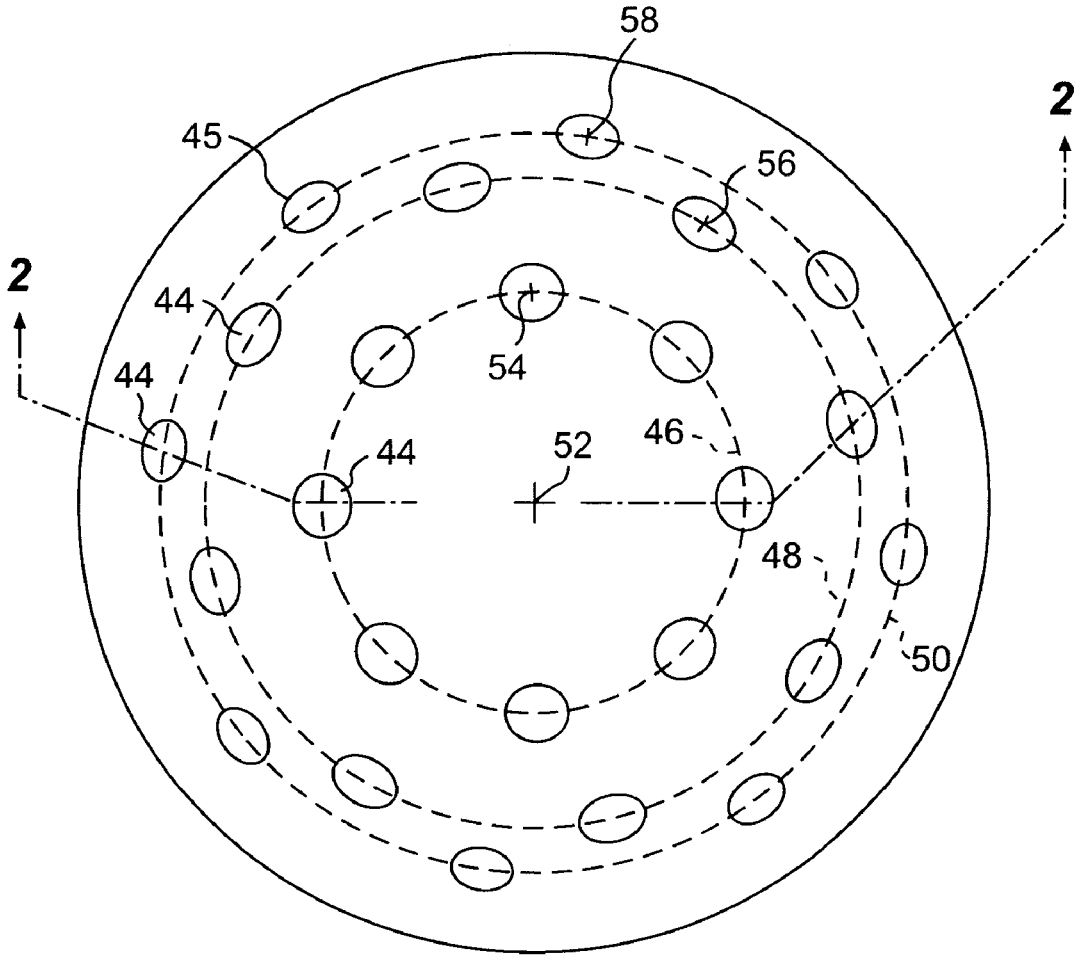
FIG. 3 is an enlarged internal view of the nozzle tip of FIG. 2.

FIG. 3 illustrates an internal view of the nozzle tip 32 of FIG. 2. As illustrated, tip sac 38 may include a total of twenty four (24) passages 44, with three groups of eight (8) passages 44 forming three different rings 46, 48, 50 about the inner surface 40 of tip sac 38. The inner ring 46 of passages 44 will be hereinafter referred to as the distal ring 46, the second ring 48 of passages 44 will hereinafter be referred to as the intermediate ring 48, and the outer ring 50 of passages 44 will hereinafter be referred to as the proximal ring 50. As illustrated in FIG. 3, the rings (46, 48, 50) formed in the inner surface 40 of the tip sac 38 each have inner surface apertures 45 lying in, or lying substantially in, a common plane. These three different common planes of rings 46, 48, and 50 will be hereafter identified as distal common plane 49, intermediate common plane 51 and proximal common plane 53, and are shown in FIG. 2. The distal, intermediate and proximal common planes 49, 51, 53 are substantially parallel to one another and substantially perpendicular to the longitudinal axis 17 of the combustion chamber 10. As stated herein, the phrase "lying in a common plane" or "located in a common plane" includes a ring (46, 48, 50) configured so that a plane extends through any portion of each of the inner surface apertures 45 of passages 44 forming the particular ring (46, 48, 50). It is understood that a fuel injector orientated at an acute angle with respect to the longitudinal axis 17 of the combustion chamber 10 will still have passages 44 forming common planes 49, 51, 53 lying substantially perpendicular to the longitudinal axis 17 of the combustion chamber 10.

The intermediate ring 48 of passages 44 may be arranged closer to the proximal ring 50 than the distal ring 46. Alternatively, intermediate ring 48 and proximal ring 50 may be combined to form a single ring of passages 44, with each opening 44 in the single ring located in substantially a common plane. As shown in FIG. 3, intermediate ring 48 and proximal ring 50 each include eight (8) passages 44 together totaling twice the number of passages 44 of the distal the ring 46. Accordingly, a nozzle tip 32 according to the present disclosure may include an intermediate ring 48 and proximal ring 50 together totaling at least twice the number of passages 44 of the distal ring 46.

Referring again to FIG. 2, the passages 44 of the distal ring 46 each have a longitudinal axis 54 at acute angles alpha ($\alpha$) from the distal common plane 49. The passages 44 of intermediate ring 48 each have longitudinal axes 56 at acute angles theta ($\theta$) from the intermediate common plane 51. Further, the passages 44 of proximal ring 50 each have a longitudinal axis 58 at acute angles beta ($\beta$) from the proximal common plane 53. The acute angles for alpha ($\alpha$), theta ($\theta$) and beta ($\beta$) are measured in a plane that is perpendicular to the common planes 49, 51, 53. The acute angles for alpha ($\alpha$), theta ($\theta$) and beta ($\beta$) may be as follows:

alpha (α)~≧55° theta (θ)~≧27.5° beta (β)~≧27.5°

For example, the nozzle tip 32 of FIG. 2 may include acute angles alpha (α) equal to approximately 55° from the distal common plane 49, and acute angles theta (θ) and beta (β) equal to approximately 27.5° from the intermediate and proximal common planes 49, 51. Further, the nozzle tip 32 of FIG. 2 may include acute angles alpha (α) equal to or greater than approximately 65° from the distal common plane 49, and acute angles theta (θ) and beta (β) equal to or greater than approximately 45° from the intermediate and proximal common planes 49, 51. Even further, nozzle tip 32 may include the passages 44 of distal ring 46 all at a substantially common acute angle alpha (α) equal to approximately 65° from the distal common plane 49, and passages 44 of the intermediate ring 48 and proximal ring 50 all at approximately the same acute angle theta (θ) and beta (β) equal to approximately 45° from the intermediate and proximal common planes 49, 51. It is understood, however, that passages 44 forming an individual ring (46, 48, 50) do not all have to be oriented at the same acute angle.

Even further nozzle tip arrangements may be contemplated by this disclosure. For example, a nozzle tip 32 may include a total of twenty four (24) passages 44 with a substantially common acute angle alpha (α) equal to or greater than approximately 60° from the distal common plane 49, and a substantially common acute angle theta (θ) and beta (β) equal to or greater than approximately 37.5° from the intermediate and proximal common planes 51, 53. Even further, a nozzle tip having a total of twenty four (24) passages 44 may have an acute angle alpha (α) equal to or greater than approximately 55° from the distal common plane 49, and an acute angle theta (θ) and beta (β) equal to or greater than approximately 27.5° from the intermediate and proximal common planes 51, 53.

Acute angles theta (θ) and beta (β) may extend at the same or different acute angles from respective intermediate and proximal common planes 51, 53. For example, an arrangement of passages 44 according to this disclosure may include acute angles of alpha (α) equal to approximately 82.5°, theta (θ) equal to approximately 67.5° and beta (β) equal to approximately 52.5°. Further, each ring (46, 48, 50) of passages 44 may be formed with substantially the same diameter and shape, or the rings may have passages 44 of a different diameter and/or shape than passages 44 of another ring. For example, each of the passages 44 of the nozzle tip 32 of FIG. 2 may have a diameter of approximately 0.105 mm (0.0041 inches).

Figure 4:
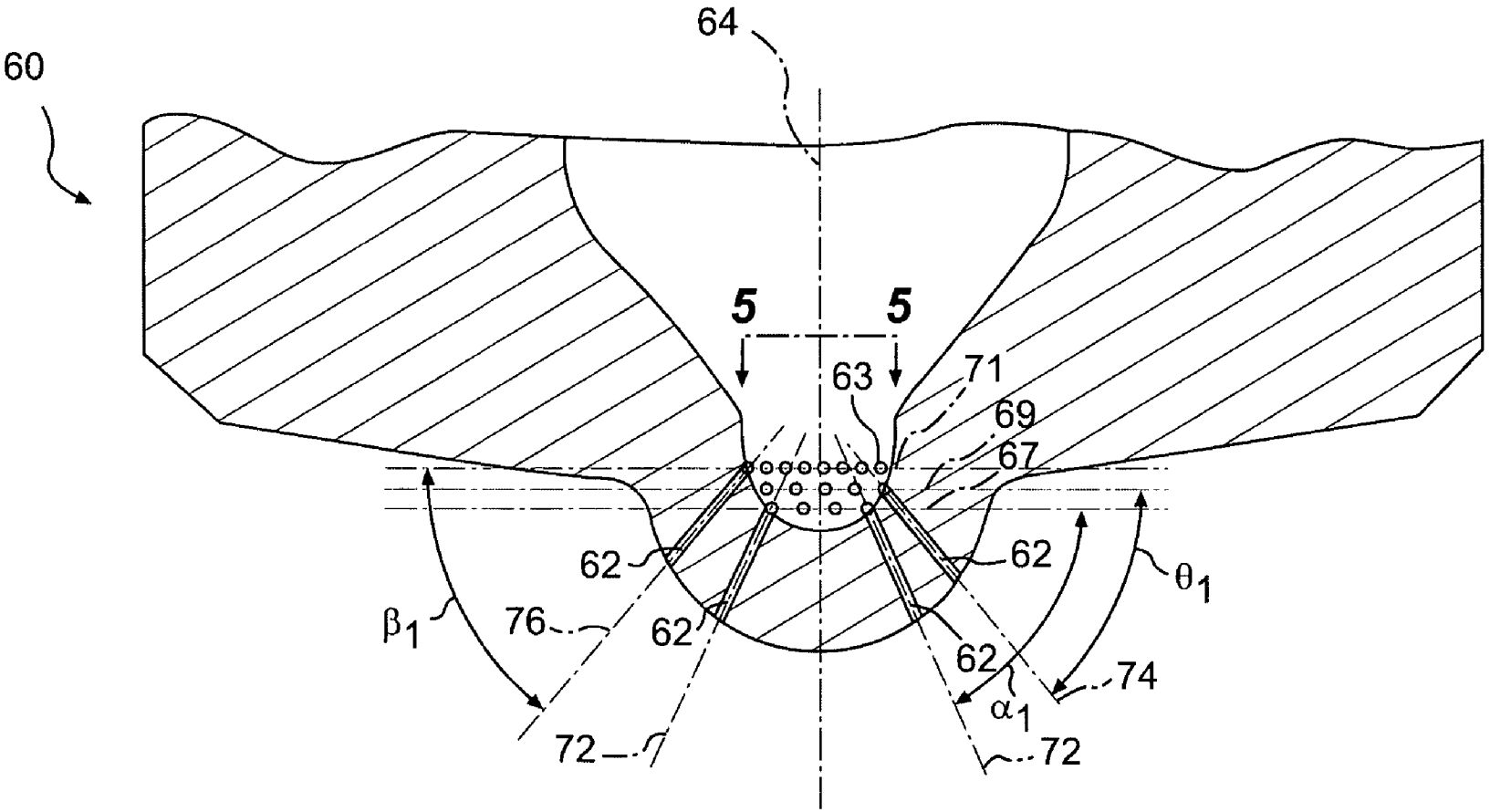
FIG. 4 is an enlarged cross-sectional view of an alternative fuel injector nozzle tip according to the disclosure.
Figure 5:
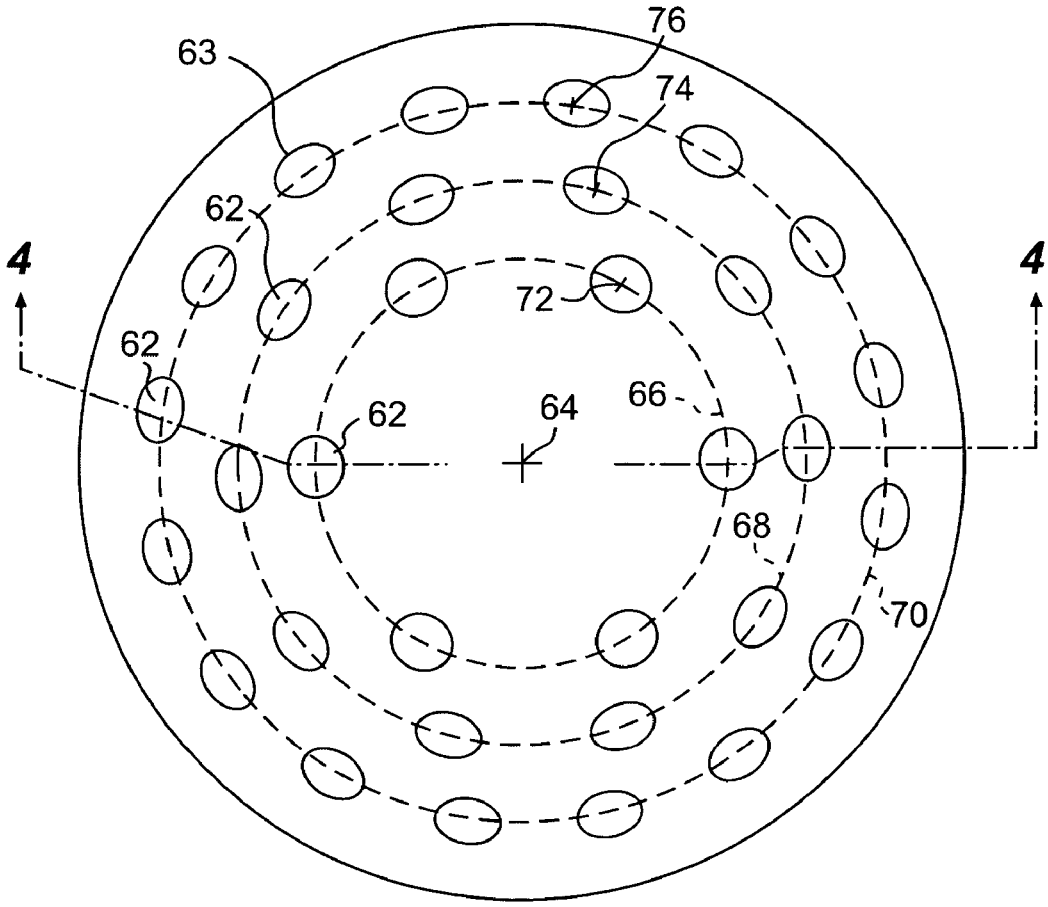
FIG. 5 is an enlarged internal view of the nozzle tip of FIG. 4.

FIGS. 4 and 5 illustrate an alternative injector nozzle tip 60 according to the present disclosure. Nozzle tip 60 includes a plurality of passages 62 extending through the nozzle tip 60. Similar to the passages 44 discussed above with respect to FIGS. 2 and 3, inner surface apertures 63 of passages 62 of the nozzle tip 60 of FIGS. 4 and 5 form a distal ring 66, an intermediate ring 68 and a proximal ring 70 (FIG. 5) and may be substantially cylindrical or tapered in shape. Again, similar to the nozzle tip 32, passages 62 of each individual ring (66, 68, 70) lie in, or substantially lie in, a common plane, with each common plane. These three different common planes 67, 69 and 71 are substantially parallel to one another and are shown in FIG. 4.

Each of the passages 62 of the distal ring 66, intermediate ring 68 and proximal ring 70 have a longitudinal axis 72, 74 and 76, respectively (FIG. 4). In contrast to nozzle tip 32 of FIGS. 2 and 3, the rings (66, 68, 70) of nozzle tip 60 are substantially equally spaced from one another. Further, nozzle tip 60 includes a total of thirty two (32) passages 62, with six (6) passages 62 in the distal ring 66, ten (10) passages 62 in the intermediate ring 68, and sixteen (16) passages 62 in the proximal ring 70. Similar to the nozzle tip 32 of FIGS. 2 and 3, the intermediate and proximal rings 68, 70 of nozzle tip 60 together have passages 62 totaling at least twice as many passages 62 as the distal ring 66 of the nozzle tip 60.

Referring to FIG. 4, the passages 62 of the distal ring 66 are at acute angles $alpha_1$ ($\alpha_1$) from the distal common plane 67, passages 62 of the intermediate ring 68 are at acute angles $theta_1$ ($\theta_1$) from the intermediate common plane 69, and the passages 62 of proximal ring 70 are at acute angles $beta_1$ ($\beta_1$) from the proximal common plane 71. As noted above with respect to the angle measurements for nozzle tip 32, acute angles for $alpha_1$ ($\alpha_1$), theta, ($\theta_1$) and beta, ($\beta_1$) are measured in a plane that is perpendicular to the common planes (67, 69, 71). The acute angles for $alpha_1$ ($\alpha_1$), theta, ($\theta_1$) and beta, ($\beta_1$) may be as follows:

$alpha_1$ ($\alpha_1$)~≧75°

$theta_1$ ($\theta_1$)~≧60°

$beta_1$ ($\beta_1$)~≧45°

For example, the nozzle tip 60 of FIG. 4 may include passages 62 at a substantially common acute angle $alpha_1$ ($\alpha_1$) equal to approximately 75° from the distal common plane 67, passages 62 at a substantially common acute angle $theta_1$ ($\theta_1$) equal to approximately 60° from the intermediate common plane 69, and passages 62 at a substantially common acute angle $beta_1$ ($\beta_1$) equal to approximately 45° from the proximal common plane 71. Passages 62 forming an individual ring (66, 68 and 70) do not all have to be oriented at the same acute angle.

Each ring (66, 68, 70) of passages 62 of the nozzle tip 60 may be formed with substantially the same diameter and shape, or the rings may have passages 62 of a different diameter and/or shape than passages 62 of another ring. For example, each of the passages 62 of FIG. 4 may have a diameter of approximately 0.075 mm (0.0029 inches).

INDUSTRIAL APPLICABILITY

Reference will now be made to the operation of the nozzle tip 32 (FIG. 2 and FIG. 3) of the combustion chamber 10 of an internal combustion engine according to the present disclosure. The nozzle tip 32 associated with this exemplary operational description includes passages 44 having a substantially common acute angle alpha (α) equal to approximately 65° from the distal common plane 49, and a substantially common acute angle theta (θ) and beta (β) equal to approximately 45° from the intermediate and proximal common planes 51, 53. Further, the operation will be described in connection with a controlled auto-ignition or HCCI technique, but it is understood that the nozzle tips of the present disclosure may be utilized in conventional high compression injection techniques as well.

Referring to FIG. 4, the auto-ignition technique includes the steps of providing air into the combustion chamber 10, injecting fuel into the combustion chamber 10 through the plurality of passages 44 located in the nozzle tip 32 of the fuel injector 30 so as to form a plurality of fuel plumes 78 in the combustion chamber 10, and compressing the air and fuel in the combustion chamber 10 to auto-ignite the mixture. The injecting step may be initiated prior to a piston position of approximately 70 degrees before top dead center and the injection step occurs only once per cycle of the piston 16. It is understood that other gases may be provided to the combustion chamber 10, for example exhaust gases may be present by way of an exhaust gas recirculation (EGR) system.

Figure 6:
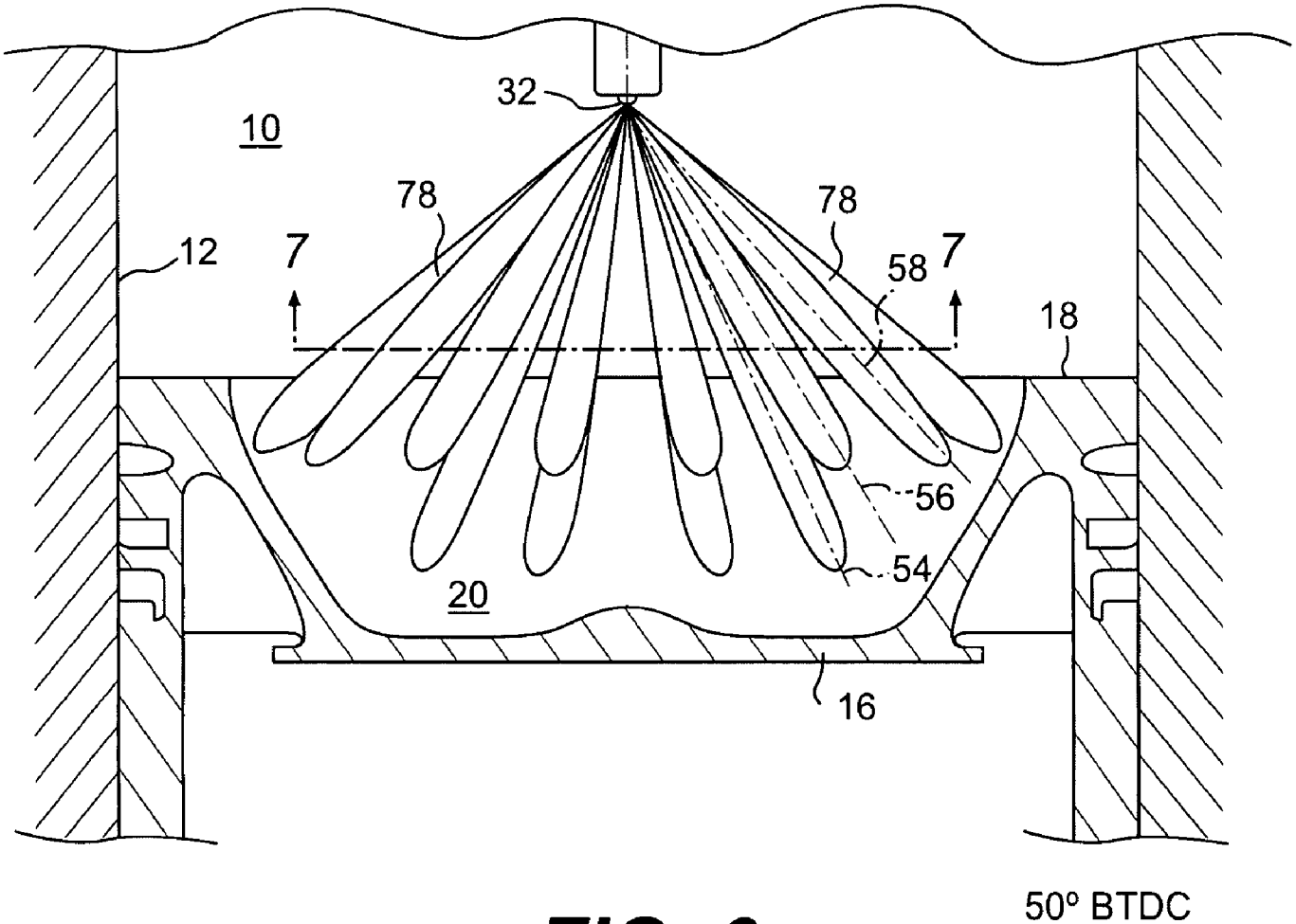
FIG. 6 is a schematic illustration of fuel plumes provided by the nozzle tip of FIGS. 2 and 3.

FIG. 6 illustrates the compression stroke of piston 16 at a piston position of 50° before top dead center (BTDC). At this point in the combustion cycle, intake air has entered the combustion chamber 10 and is being compressed and mixed with fuel injected from nozzle tip 32. As noted above, other gases may exist in combustion chamber 10, for example exhaust gases may be present by way of an exhaust gas recirculation (EGR) system. The injected fuel, for example diesel fuel, forms fuel plumes 78 within the combustion chamber 10. As the piston 16 progresses toward top dead center, the air/fuel mixture is compressed and eventually auto-ignites when the pressure in the combustion chamber 10 exceeds a threshold auto-ignition pressure of the mixture. The fuel plumes 78 according to this arrangement of passages 44 provide completely or substantially completely developed fuel plumes 78 when the piston is at a position of approximately 50° BTDC. These completely or substantially completely developed fuel plumes 78 are near but are not substantially in contact with the cylinder sidewall 12 when the piston is at a position of approximately 50° BTDC. It is noted that the fuel injector 30 having this nozzle tip arrangement may be initiated when the piston is approximately 90° BTDC. As understood in this disclosure, initiation of the fuel injector 30 corresponds to the sending of an electrical signal energizing the fuel injector for fuel injection, or the beginning of a mechanical actuation of the fuel injector 30 associated with injecting fuel from the fuel injector 30.

Figure 7:
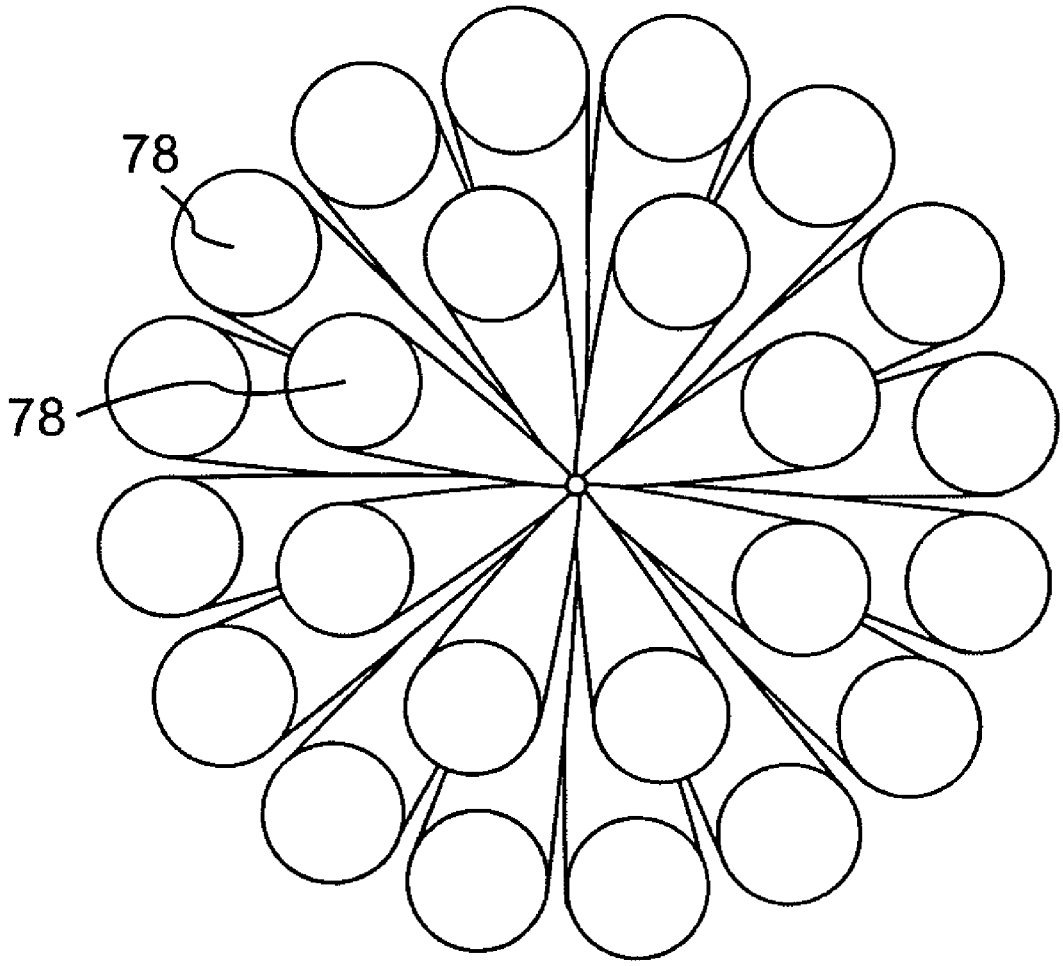
FIG. 7 is a schematic illustration of a cross-sectional end view of the fuel plumes illustrated in FIG. 6.

FIG. 6 illustrates the fuel plumes 78 in a completely or substantially completely developed state. The minimal contact with the cylinder sidewall 12 is based on the fact that the fuel plumes 78 each generally follow the longitudinal axes (54, 56, 58) of their corresponding passage 44. As shown in dotted lines in FIG. 6, the longitudinal axes 54, 56 and 58 all extend into the piston crater 20 when the piston 16 is at a piston position of 50° BTDC. Such an arrangement provides fuel plumes 78 that do not, or only minimally, contact the cylinder sidewall 12 of combustion chamber 10. Further, the injector passages 44 also provide for individual fuel plumes 78 that do not substantially overlap or intersect one another. This aspect of the fuel plumes 78 is illustrated in FIG. 7, which shows an end view cross-section of the fuel plumes 78 provided by the nozzle tip 32.

In addition to providing substantially completely developed, non-overlapping, fuel plumes 78 minimally contacting the cylinder sidewall 12, passages 44 in nozzle tip 32 also provide for a highly homogenous mixture of fuel within the combustion chamber 10. When used in a controlled auto-ignition or HCCI type combustion technique, the highly homogenous mixture provides reduced smoke exhaust, reduced NOx, and a reduction in unburned hydrocarbons resulting in improved emissions and better fuel economy. Even when used in a non-HCCI direct injection technique, the passages 44 of nozzle tip 32 reduce the formation of detrimental high temperature regions within the combustion chamber 10.

Nozzle tip 60 provides for fuel plumes similar to those of nozzle tip 32, except that angle differences between $theta_1$ ($\theta_1$) and $beta_1$ ($\beta_1$) create a third ring of fuel plumes. Fuel plumes provided by nozzle tip 60 having an acute angle $alpha_1$ ($\alpha_1$) equal to approximately 75°, an acute angle $theta_1$ ($\theta_1$) equal to approximately 60° and an acute angle $beta_1$ ($\beta_1$) equal to approximately 45° are completely or substantially completely developed when the piston 16 is located approximately 50° BTDC. These completely or substantially completely developed fuel plumes are adjacent but not substantially in contact with the cylinder sidewall 12 when the piston 16 is located approximately 50° BTDC. Further, the longitudinal axes of the passages 44 formed by nozzle tip 60 do not initially intersect the cylinder wall 12, but rather extend into the piston crater 20 when the piston 16 is approximately 50° BTDC. It is noted that the fuel injector having this nozzle tip 60 may be initiated when the piston 16 is at a position of approximately 90° BTDC.

Even further, nozzle tip 32 described above with acute angles alpha ($\alpha$) equal to or greater than approximately 60° from the distal common plane 49 and a substantially common acute angle theta ($\theta$) and beta ($\beta$) equal to or greater than approximately 37.5° from the intermediate and proximal common planes 51, 53 may provide substantially completely developed fuel plumes when the piston 16 is at a position of approximately 40° BTDC. When the longitudinal axes of passages 44 are arranged at such acute angles they do not initially intersect the cylinder sidewall 12, but rather extend into the piston crater 20 when the piston 16 is at a position of approximately 40° BTDC. The fuel injector 30 having this nozzle tip may be initiated when the piston is at a position of approximately 80° BTDC.

Finally, the above described nozzle tip having acute angles alpha ($\alpha$) equal to or greater than approximately 55° and an acute angle theta ($\theta$) and beta ($\beta$) equal to or greater than approximately 27.5° may provide substantially completely developed fuel plumes when the piston 16 is at a position of approximately 30° BTDC. When the longitudinal axes of passages 44 are arranged at such angles they do not initially intersect the cylinder sidewall 12, but rather extend into the piston crater 20 when the piston 16 is at a position of approximately 30° BTDC. The fuel injector 30 with this nozzle tip arrangement may be initiated when the piston is at a position of approximately 70° BTDC.

Other embodiments of the invention will be apparent to those skilled in the art from consideration of the specification and practice of the invention disclosed herein. It is intended that the specification and examples be considered as exemplary only, with a true scope of the invention being indicated by the following claims.

What is claimed is:

1. A method of providing combustion with a combustion chamber of an internal combustion engine, comprising:

providing air into the combustion chamber;

initiating a fuel injector to inject fuel into the combustion chamber through a nozzle tip of the fuel injector before auto ignition conditions exist within the combustion chamber; and compressing the air and fuel mixture in the combustion chamber to auto-ignite the mixture, the nozzle tip including, an outer nozzle tip surface portion;

an inner nozzle tip surface portion;

a plurality of passages allowing fluid communication between the inner nozzle tip surface portion and the outer nozzle tip surface portion and directly into a combustion chamber of an internal combustion engine, each of the plurality of passages having an inner surface aperture on the inner nozzle tip surface portion and an outer surface aperture on the outer nozzle tip surface portion;

a first group of said passages having outer surface apertures located substantially in a first common plane; and a second group of said passages having outer surface apertures located substantially in at least a second common plane substantially parallel to the first common plane;

further including forming a plurality of fuel plumes in the combustion chamber, each of the plurality of fuel plumes corresponding to one of said plurality of passages and sharing a longitudinal axis with the corresponding passage, the axis of each passage extending into a piston of the combustion chamber at a piston position of approximately 30 degrees before top dead center.

2. The method of providing combustion according to claim 1, wherein the second group of passages includes a third group of passages having inner surface apertures located substantially in a third common plane substantially parallel to the first and second common planes.

3. The method of providing combustion according to claim 1, wherein the second group includes at least twice as many passages as the number of passages of the first group.

4. The method of providing combustion according to claim 1, wherein the second group includes at least twelve passages.

5. The method of providing combustion according to claim 1, wherein the first and second groups together total at least twenty four passages.

6. The method of providing combustion according to claim 1, wherein the inner nozzle tip surface portion and the outer nozzle tip surface portion are each concavely rounded to form a portion of a nozzle tip sac.

7. The method of providing combustion according to claim 1, wherein the first group of passages each have a longitudinal axis extending at a substantially common acute angle alpha ($\alpha$) of approximately 65 degrees or greater from first common plane, the acute angle alpha ($\alpha$) being measured in a plane perpendicular to the first common plane.

8. The method of providing combustion according to claim 7, wherein the second group of passages each have a longitudinal axis extending at a substantially common acute angle theta ($\theta$) of approximately 45 degrees or greater from the second common plane, the acute angle theta ($\theta$) being measured in a plane perpendicular to the second common plane.

9. The method of providing combustion according to claim 1, wherein initiating the fuel injector to inject fuel includes initiating a fuel injector to inject fuel into the combustion chamber when a piston of the combustion chamber is located between the range of approximately 90 degrees to approximately 70 degrees before top dead center.

10. The method of providing combustion according to claim 1, wherein initiating the fuel injector to inject fuel includes initiating a fuel injector to inject fuel into the combustion chamber when a piston of the combustion chamber is located before a position of 90 degrees before top dead center.

11. A method of providing combustion with a combustion chamber of an internal combustion engine, comprising:

providing air into the combustion chamber;

initiating a fuel injector to inject fuel into the combustion chamber through a nozzle tip of the fuel injector when a piston of the combustion chamber is located between the range of approximately 90 degrees to approximately 70 degrees before top dead center; and compressing the air and fuel mixture in the combustion chamber to auto-ignite the mixture, the nozzle tip including, an outer nozzle tip surface portion;

an inner nozzle tip surface portion;

a plurality of passages allowing fluid communication between the inner nozzle tip surface portion and the outer nozzle tip surface portion and directly into a combustion chamber of an internal combustion engine, each of the plurality of passages having an inner surface aperture on the inner nozzle tip surface portion and an outer surface aperture on the outer nozzle tip surface portion;

a first group of said passages having inner surface apertures located substantially in a first common plane; and a second group of said passages having inner surface apertures located substantially in at least a second common plane substantially parallel to the first common plane.

12. A method of providing combustion with a combustion chamber of an internal combustion engine, comprising:

providing air into the combustion chamber;

initiating a fuel injector to inject fuel into the combustion chamber through a nozzle tip of the fuel injector when a piston of the combustion chamber is located before a position of 90 degrees before top dead center; and compressing the air and fuel mixture in the combustion chamber to auto-ignite the mixture, the nozzle tip including, an outer nozzle tip surface portion;

an inner nozzle tip surface portion;

a plurality of passages allowing fluid communication between the inner nozzle tip surface portion and the outer nozzle tip surface portion and directly into a combustion chamber of an internal combustion engine, each of the plurality of passages having an inner surface aperture on the inner nozzle tip surface portion and an outer surface aperture on the outer nozzle tip surface portion;

a first group of said passages having inner surface apertures located substantially in a first common plane; and a second group of said passages having inner surface apertures located substantially in at least a second common plane substantially parallel to the first common plane.

* * * * *